United States Patent [19]

Sobol

[11] Patent Number: 5,067,297

[45] Date of Patent: Nov. 26, 1991

[54] EXPANSION-JOINT COVER ASSEMBLIES

[75] Inventor: John E. Sobol, Grand Island, N.Y.

[73] Assignee: Watson Bowman Acme Corp., Grand Island, N.Y.

[21] Appl. No.: 615,891

[22] Filed: Nov. 20, 1990

[51] Int. Cl.[5] ..... E04F 15/14; E04B 1/60

[52] U.S. Cl. ..... 52/396; 52/573; 404/56

[58] Field of Search ..... 52/396 I, 573, 468, 52/278, 395; 404/53, 54, 60, 57, 56, 67

[56] References Cited

U.S. PATENT DOCUMENTS 3,750,359 8/1973 Balzer et al. ..... 52/396

*Primary Examiner*—David A. Scherbel
*Assistant Examiner*—Robert J. Canfield
*Attorney, Agent, or Firm*—Jones, Day, Reavis & Pogue

[57] ABSTRACT

An improved expansion-joint cover assembly of the type having a first base member secured to a first structural section and a second base member secured to a second structural section and a flexible-spring cover member coupled between said base members and overlying the open joint. The improvement comprising an interchangeable trim strip portion removably secured to the end of a first wall defining a passageway in said second base to receive the free end of said cover member and an interchangeable spring support removably secured to the end of the second wall defining such passageway. The spring support includes a support tip which engages the cover member and forces it into intimate contact with the trim strip supporting such cover member and holding it in its closed position.

14 Claims, 3 Drawing Sheets

EXPANSION-JOINT COVER ASSEMBLIES

CROSS-REFERENCE TO RELATED APPLICATION

Application for U.S. Letters patent Ser. No. 07/540,071 filed June 19, 1990, for "Expansion Joint Cover Assemblies" by Matthew J. Clements et al., and assigned to the Assignee of the instant application.

BACKGROUND OF THE INVENTION

The present invention relates to expansion-joint cover assemblies of the type employed to bridge spaces between relatively movable structural elements such as floors or walls. More particularly, the assemblies of the present invention are suitable for use in covering expansion joints between adjacent, spaced, relatively movable structural sections such as floors or floors and walls in a manner such as to enable effective expansion performance of the joint while presenting an aesthetically improved appearance while accommodating a wide range and thickness of finish floor materials.

A variety of expansion-joint covers have been disclosed heretofore. However, such prior assemblies have presented numerous unresolved problems in regard to their mechanical operation and/or aesthetic appeal. For example, some of the prior devices have not functioned to adequately accommodate relative movement of the structural sections adjacent the expansion joint. Other prior devices have exhibited mounting and installation problems as well as problems in regard to the maintenance of their position within the expansion joint throughout prolonged periods of use. Prior expansion joint covers have also encountered problems in regard to continued operability in the event of build-up of dirt deposits within the operating components of the assemblies.

From an aesthetic standpoint, prior expansion-cover assemblies have not been satisfactorily designed and structured. Prior devices have been constructed in a manner such that the metal and/or plastic surface of the cover is exposed after assembly and installation resulting in a generally undesirable and unattractive appearance which does not blend in with the surroundings and adjacent construction.

One example of the many varieties of prior art expansion-joint covers which have proposed to overlie elongate expansion joints between adjacent building sections such as floors or floors and walls is disclosed in U.S. Pat. No. 3,750,359 issued Aug. 7, 1973, to C.P. Balzer et al. In that patent, a free-floating elongate arcuate rigid cover or plate member is disclosed for use in bridging the span between adjacent, spaced floor sections. For purposes of providing a covering between floor and wall sections, an assembly is disclosed wherein the free-floating cover or plate is replaced with a rigid cover or plate member which is pivotally connected via a hinge arrangement to the wall.

These prior devices have presented problems in regard to mechanical functionality as well as to aesthetic appearance. For example, it has been found that free-floating covers which are not fastened or secured in assembly present problems in remaining centered over the expansion opening as required to enable continued effective utilization. Hinged or pivotal connections for wall to floor installations also have been found to present operational difficulties, for example, in view of dirt accumulation in the hinge area which prevents proper pivotal operation of the assembly. Furthermore, with regard to devices such as those disclosed in U.S. Pat. 3,750,359, a significant problem is presented regarding the high degree of exposed metal or plastic surface which is observable after the assembly is installed in a location whereas a major concern of developers of such cover-assembly products is to minimize exposure of the surface in order to enhance the aesthetic properties of the installed assembly.

Further examples of prior expansion joint cover assemblies are disclosed in U.S. Pat. Nos. 3,170,268; 3,659,390; 3,797,188; 3,849,958; 4,184,298; 4,504,170; 4,885,885 and 4,901,495. In each of these patents, a distinct cover arrangement is disclosed for bridging the gap between adjacent structural sections to accommodate relative movement therebetween.

Thus, it has been a continuing problem for the developers of expansion-joint cover assemblies to provide functionally effective products which are cost effective and are constructed in a manner enabling ease of installation and which provide adequate initial and long-term mechanical operability. Furthermore, it has been a continuing problem to provide cover assemblies which provide floor joints which are flush with the finished floor construction.

In addition, the developers of expansion-joint cover assemblies have encountered significant problems in creating aesthetically pleasing structures which only display a minimum of exposed metal or other material surface upon installation allowing the cover to blend in with the surroundings and adjacent construction.

Although the expansion-joint cover assemblies of the above-identified co-pending application go a long way toward solving the various identified mechanical aspects and of providing a joint-cover assembly which can be made aesthetically pleasing by appropriate finish floor materials, the approach taken limits the ability to readily change the finish floor materials. The desire to change the materials may be due to redecoration of floors and walls of the structure about the expansion joint or replacement of the materials due to normal wear and tear. The result may be that the materials are thicker or thinner as where a carpet is substituted for tile or vice versa or more space may be required for the materials as where the new carpet has a border or the tile a distinctive pattern.

Also, it may be desirable to change the material or color of the lip which borders the carpet or tile from, for example, chrome to bronze.

Under these circumstances, using the approach of the above-identified co-pending application, it would be necessary to fabricate new extrusions so dimensioned and colored to accept the extended or reduced material surface, the change in finish floor material height and provide the desired finish color. The extrusions then in place would have to be removed and the new ones installed with the attendant noise, dust, dirt and disruption of adjacent facilities.

SUMMARY OF THE INVENTION

Therefore, the present invention provides expansion-joint cover assemblies specifically structured and dimensioned for use in covering expansion joints or spaces between adjacent structural sections of a building such as spaced floors or floor and wall sections. The assemblies include base members adapted to be positioned and secured to the adjacent structural sections and a leaf-spring cover member fixedly interconnected to one of the base members at one end and bridging the expansion joint or space between the structural sections in a cantilever manner such that the cover member lies in a plane essentially flush or coextensive with the floor section or sections and is structured and dimensioned to be slidably interconnected with the other base member to provide a secure and functionally effective assembly for accommodating translational relative movement of the structural sections.

A salient feature of the present invention is the ability to readily interchange the trim strip which constitutes a portion of a first base member to accommodate changes in the thickness of finish floor materials placed over such base member to change the extent of the area which can accept such materials and alter the trim color. A readily interchangeable leaf-spring support permits variation of the thickness of the finish floor materials placed on the leaf-spring cover member without replacement of the entire base member.

More particularly, it is a significant feature of the present invention that the assembly is constructed in a manner such that, when installed, only minimal surface area of the component parts of the assembly is exposed to view. This construction enables the assembly to blend in with the surroundings and adjacent construction providing an aesthetically attractive appearance.

A further feature of the present invention is to provide an expansion-joint cover assembly that is constructed such that the cover is essentially coplanar or flush with adjacent structural floor sections.

It is another feature of this invention that the assembly is adapted to accommodate multi-directional relative movement of adjacent structural surfaces and to function effectively over long periods of time without encountering mechanical difficulties.

It is still another important feature of the present invention that the assemblies are constructed for efficient and easy mounting and installation. Furthermore, the assemblies are cost efficient in production.

These features and advantages are obtained, and it is a general object of the present invention to obtain these advantages by providing an aesthetically attractive, cost-efficient expansion-joint cover assembly which possesses necessary performance characteristics in movement and sealing and which may be mounted and installed with facility. The assembly is inset into the joint between structural floor and/or wall sections and is structured and dimensioned to provide an outer surface cover for the joint which is essentially coplanar or flush with the adjacent structural sections with only minimal exposure of the surface of the assembly.

The expansion-joint cover assembly comprises a first elongate base member stationarily secured to a first structural section and a second elongate base member positioned within a recess formed in a second structural section adjacent the first structural section and spaced therefrom. The second base member is stationarily secured to the second structural section. The cover assembly further includes an elongate cover member having oppositely disposed, longitudinally spaced first and second end sections with the first end section fixedly interconnected with the first base member, and the second base member includes a passageway therein for receiving the second end section of the cover member in supporting, sliding engagement. The cover member extends across a joint or space formed between the adjacent structural sections in a cantilever manner overlying and covering the joint with said second end section of the cover member inserted in said passageway to accommodate relative movement of the adjacent, spaced structural sections and to assure proper alignment of the cover member.

The free end of one of the members defining the passageway is fitted with a replaceable top portion which projects toward a replaceable top portion which projects toward a replaceable trim strip fitted to the second member defining the passageway. The size and position of the trim strip together with the height of the top portion define the width of the passageway and provide support for the cover member with attached finish floor material.

DESCRIPTION OF THE PREFERRED EMBODIMENT

Figure 1:
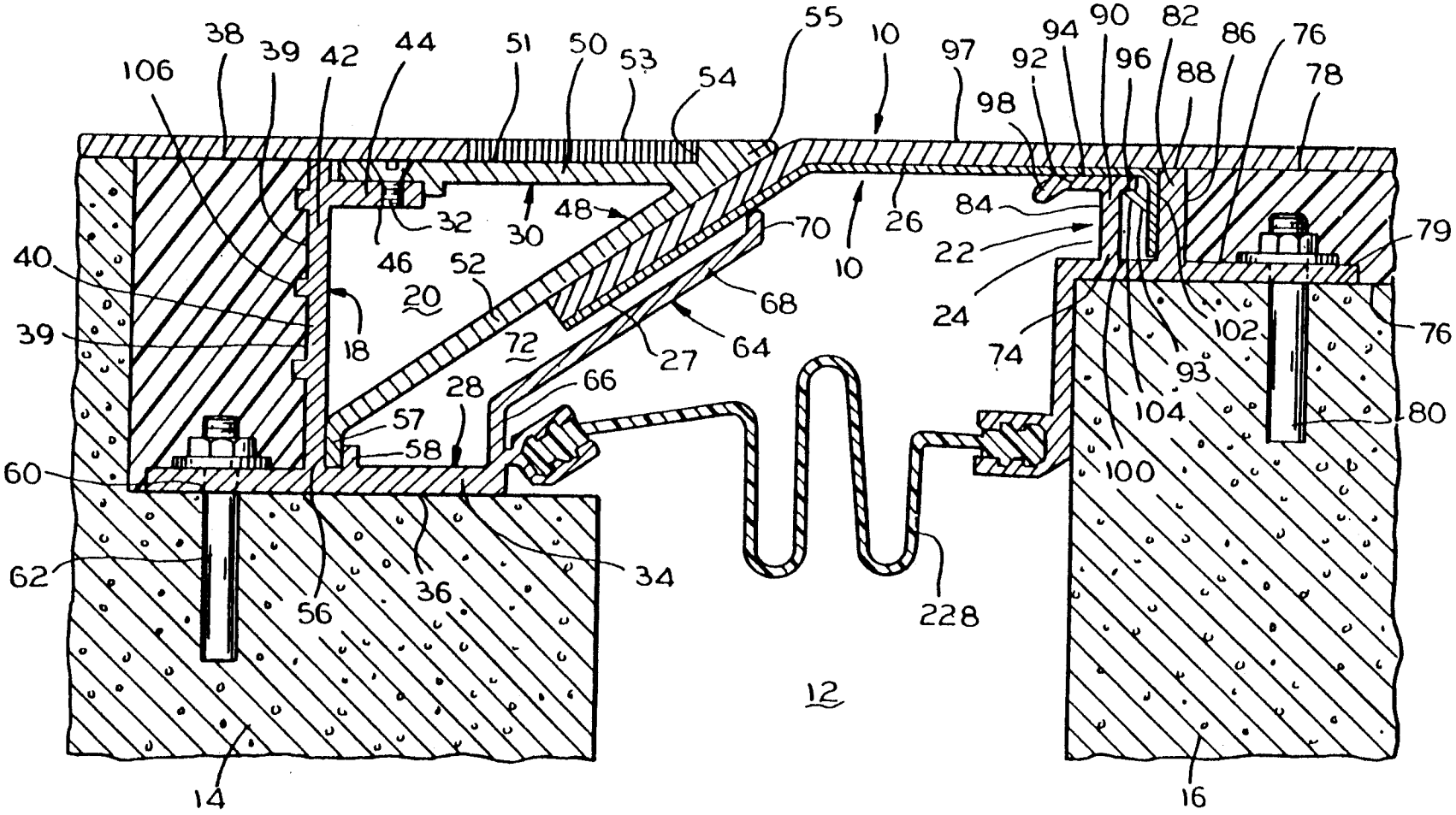
FIG. 1 (PRIOR ART)
FIG. 1 is a transverse sectional view of the installed expansion-joint cover assembly of the above-identified co-pending application and the adjacent building sections with carpet laid thereon and is FIG. 2 of such application.

A description of the invention follows, referring to the drawings in which like reference numerals denote like elements of structure in each of the several figures.

Figure 2:
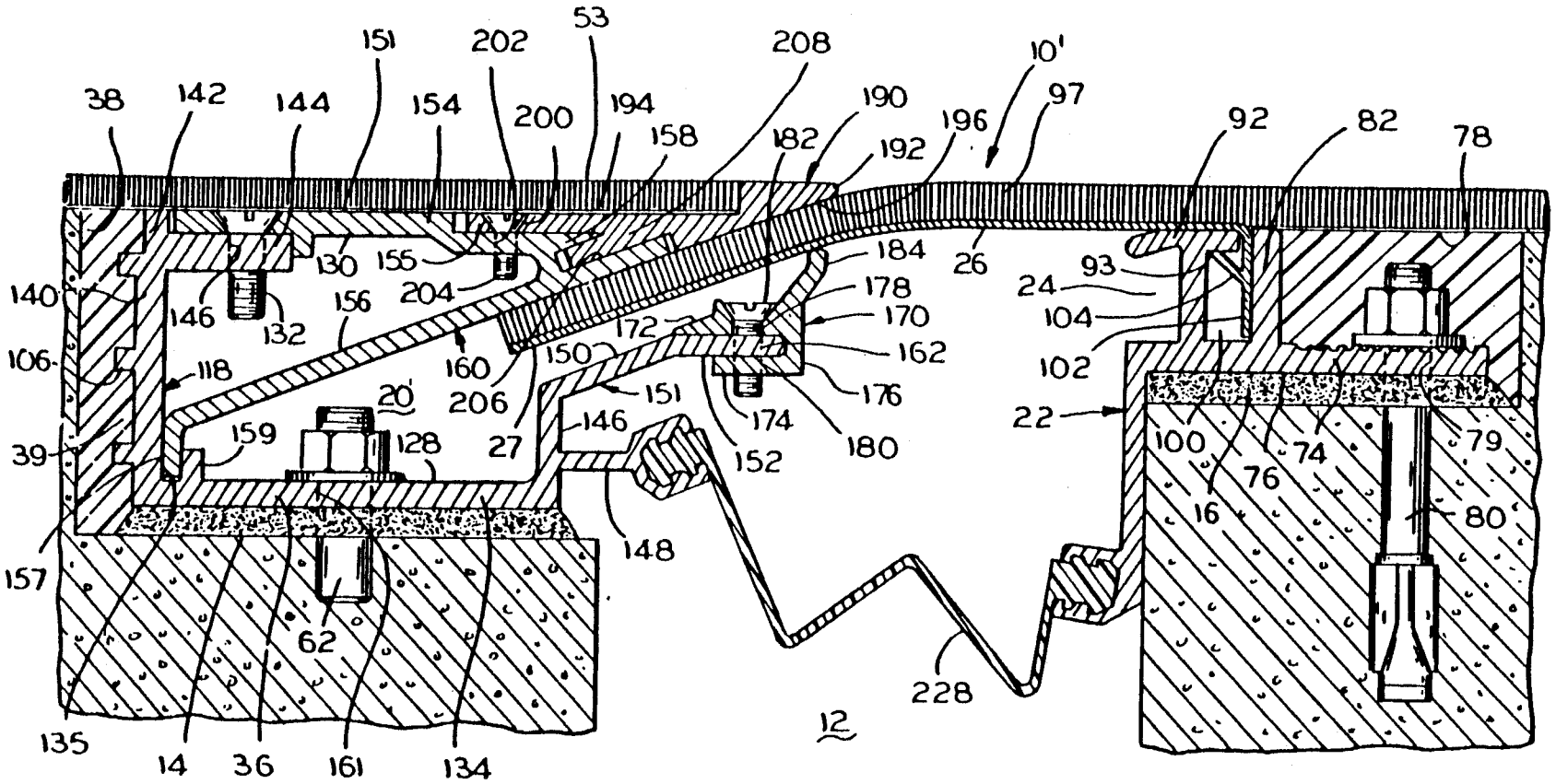
FIG. 2 is a transverse sectional view of improved expansion-joint cover assemblies in accordance with the concepts of the present invention installed to cover an expansion joint between adjacent carpeted floor sections.

Referring now to FIG. I of the drawing, there is illustrated an expansion-joint cover assembly, generally designated by the numeral 10, more fully described in the above-identified co-pending application and by this reference made a part hereof. In use, the expansion-joint cover assembly 10 is installed overlying and covering an elongate expansion joint or space 12 between adjacent portions of a building structure having structural sections 14 and 16 spaced apart and separated by the expansion joint or space 12. The structural sections 14 and 16, as illustrated in FIGS. 1 and 2, are building floors. However, it is to be noted that the structural sections 14 and 16 may be two floor sections or a floor and a wall section (see FIG. 3) or other like structural components of a building within the scope of this invention. Such structural sections 14 and 16 may be constructed of any suitable material such as concrete, building blocks, bricks, metal or any other suitable material or combination thereof.

The expansion-joint cover assembly 10 is structured and dimensioned to cover the elongate expansion joint 12 which extends between structural sections 14 and 16. This assembly 10, furthermore, is adapted to accommodate relative movement between the adjacent sections 14 and 16. As illustrated in FIG. 1, the assembly 10 includes an elongate rigid base member 18 positioned in a recessed area 20 formed in floor section 14 and secured to section 14 in a manner such that member 18 is held in a stationary or fixed position relative to section 14. Another elongate base member 22 is positioned in a recessed area 24 formed in floor section 16 and is secured to section 16 in a manner such that member 22 is held in a stationary or fixed position relative to section 16. Base members 18 and 22 may be fabricated from any suitable metallic material such as extruded metals including aluminum or brass or from a suitable plastic material.

The cover assembly 10 further includes an elongate leaf-spring cover member 26 constructed from any suitably springy or resilient material such as spring metal stock having a thickness sufficient to provide a joint-cover construction capable of supporting a load, for example, of up to about 150 pounds per square foot. In use, it is contemplated that when the leaf-spring cover member 26 is employed to cover a six-inch joint between structural sections, the leaf spring should have a thickness of up to about 0.062 inch for best results. In other applications, lesser-thickness leaf springs have been found to be adequate for utilization such as, for example, a 0.030-inch thick leaf spring utilized for a four-inch joint. Furthermore, it has been found that if additional stiffness of the leaf spring is desired, an additional leaf may be affixed as by spot welding or the like to an end section of the leaf-spring cover member 26 opposite the free end section 27.

In assembly, the leaf-spring member 26 is fixedly attached to base assembly 22 and bridges joint 12 overlying and covering the space between sections 14 and 16. The leaf-spring member 26 is slidably engaged by and operatively interconnected with base 18 as will be further detailed hereinafter.

Base member 18 may be formed as a unitary construction, if desired. However, in a preferred embodiment of this invention as illustrated, practical installation of the leaf-spring 26 is facilitated by employing a member 18 comprising two elongate sub-sections 28 and 30 which are interconnected at one end via screws 32. Sub-section 28 includes a horizontally extending bottom portion or member 34 which is positioned in abutting engagement with a lower wall surface 36 of recess 20 of structural section 14. Wall surface 36 extends in a generally horizontal plane essentially parallel to an upwardly-facing outer surface 28 of floor section 14. A laterally-elongate vertical side portion or member 40 of sub-section 28 extends generally perpendicular to and upwardly from bottom portion 34 in abutting engagement with a side wall surface 39 in recess 20. The vertical side member 40 terminates in an end section 42 which lies in a plane substantially flush with the outer surface 38 of floor 14. Adjacent terminal section 42, an elongate-lateral flange 44 is formed on vertical member 40. This flange 44 includes apertures or bores 46 which accommodate screws 32 for joining sub-sections 28 and 30.

Sub-section 30 comprises laterally elongate, rigid upper leg 50 and diagonal side leg 52. Leg 50 is structured and dimensioned to extend generally horizontally in a plane perpendicular or normal to vertical side portion 40 of sub-section 28 when sub-sections 28 and 30 are interconnected. Thus, an outer surface 51 of leg 50 lies in a plane essentially coextensive or flush with the essentially horizontal plane of outer surface 28 of floor 14. Accordingly, outer surface 51 of leg 50 is positioned to accommodate a floor covering 53 such as a carpet, tile, marble or the like or a decorative simulation thereof which is disposed or spread over the outer surface 38 of floor 14.

In order to further facilitate installation of the floor covering 53 on the outer surface 51 of leg 50, the leg 50 includes an abutment surface or lip 54 formed on the outer surface 51 adjacent a bending area or zone 55 on leg 50. The height of the lip 54 will vary depending on the thickness of the floor covering material 53. For example, the height of lip 54 will preferably be about ¼ inch for a carpet floor covering whereas the height of the lip 54 will preferably be about ⅛ inch for tile floor covering. Thus, in installation, the floor covering 53 is laid directly over outer surface 38 of floor 14 and outer surface 51 of leg 50 in a continuous covering relationship with only a minimal tip portion of the underlying surface or structure of base member 18 (i.e. bending area 55) being exposed beyond the position at which the floor covering 53 abuttingly engages abutment surface 54.

Leg 52 extends diagonally downward from the bending area 55 on upper leg 50 at an acute angle relative to leg 50 so that when the sub-sections 28 and 30 are joined, the legs 50, 52 and vertical portion 40 essentially define a cantilever bracket member 28 with leg 52 defining the hypotenuse of a right triangle.

As noted previously, the sub-sections 28 and 30 are fixedly attached to each other at one end via screws 32. At the other end, attachment of sections 28 and 30 is completed by engaging free end 57 of side leg 52 within a detent 56 formed between the vertical side member 40 of sub-assembly 28 and an adjacent upwardly-projecting elongate rib or peg 58 on bottom portion 34 of sub-assembly 28. The rib or peg 58 extends generally perpendicularly from the bottom portion 34 and essentially parallel to the vertical side portion 40.

Apertures or bores 60 are formed in bottom member 34 adjacent one end thereof to accommodate a bolt arrangement 62 such as a Hilti "Kwik" bolt for connecting the base 18 to floor section 14. An armature assembly 64 extends upwardly from the other or free end of bottom member 34 with a first section 66 extending generally normal or perpendicular to member 34 and a second section 68 being bent at an acute angle from the first section extending upwardly in a plane essentially parallel to the plane of leg 52. Section 68 terminates in a curved free elongate top portion 70 which extends generally perpendicularly from the bottom portion 34.

Thus, in assembly, second section 68 of armature assembly 64 extends generally parallel to side leg 52 of the cantilever bracket member 48 and a passageway or channel 72 is formed therebetween. This passageway 72 bordered by leg 52 and second section 68 with top portion 70 of section 68 projecting upwardly into passageway 72 is structured and dimensioned to receive the free end section 27 of leaf-spring cover member 26 in a manner such that the free end section 27 of the leaf-spring 26 is supportively and slidably engaged within the passageway 72 to accommodate multi-directional relative movement between the adjacent structures 14 and 16. Additionally, portion 70 on section 68 of armature 64 is positioned to press against the end section 27 of leaf-spring cover member 26 exerting an upwardly directed compressive force for retaining the cover member 26 in position within the passageway 72 and for resisting disengagement of the member 26 from proper positioning.

Rigid base assembly 22 includes a laterally-elongate, horizontally extending bottom portion or member 74 which is positioned in abutting engagement with a lower wall surface 76 formed in recess 24 of structural section 16. Wall surface 76 extends in a generally horizontal plane essentially parallel to an upwardly facing outer surface 78 of floor section 16 which, as illustrated, is essentially coplanar with the upwardly-facing outer surface 38 of floor section 14. Bottom member 74 has an aperture or bore 79 formed therein adjacent one of its ends to accommodate a bolt arrangement 80 such as a Hilti "Kwik" bolt for connecting the base 22 to floor section 16.

Base assembly 22 further includes two generally vertical, longitudinally-spaced, laterally elongate wall members 82 and 84 which project from the bottom member 74 at essentially right angles thereto. Wall member 82 extends upwardly in abutting engagement with a side wall surface 86 formed in recess 24 and terminates in an end section 88 which lies in a plane substantially flush with the outer surface 78 of floor 16. Wall member 84 extends upwardly to a terminal section 90 which comprises a laterally-elongate rigid cross member 92 having a substantially flat top surface 94 positioned centrally thereof interconnecting side surfaces 96 and 98. Side surface 96 comprises a continuation of the flat top surface 94 and extends in the longitudinal direction toward wall member 82 defining a flange or abutment surface 93 which extends into a channel 100 formed between the vertical wall members 82 and 84. Side surface 98 comprises an inclined surface rising from its opposite end to join at its uppermost portion with the substantially flat central top surface 94.

Cross member 92 provides support for leaf-spring cover member 26 as it projects longitudinally in a direction across joint 12 toward base member 18 in a plane essentially coextensive or flush with the outer surface 78 of floor 16 and outer surface 38 of floor 14. Accordingly, leaf-spring cover member 26 is positioned to accommodate a floor covering 97 such as a carpet, tile, marble or the like or a decorative simulation thereof which is disposed or spread over the outer surface 78 of floor 16. As illustrated, the floor covering 97 supported on cover member 26 extends completely across joint 12 and extends into passageway 72 so that the surface or structure of the leaf-spring cover member 26 and base member 22 are completely covered by the floor covering 97 and are not exposed to view when the assembly 10 is installed In the reverse direction adjacent an end section 102 oppositely disposed from free end section 27 of leaf-spring 26, the leaf-spring 26 is bent downwardly at a generally right angle to the plane of the outer surface 78 of floor 16 to enter channel 100 between the vertical walls 82 and 84 of base member 22. End section 102 of leaf-spring cover member 26 includes an upwardly projecting engagement arm or barb member 104 which is structured and dimensioned and likewise is positioned within the channel 100 to engage flange 93 so as to fixedly interconnect leaf-spring cover member 26 with base member 22.

Installation of the expansion-joint cover assembly 10, illustrated in FIG. 1, between adjacent floor sections 14 and 16 is accomplished by mounting base member 22 in recess 24 and securing the base member 22 to a concrete portion of section 16 via bolt arrangement 80. Thereafter, recess 24 is filled with grout and base member 22 is bonded thereto. Likewise, sub-section 28 of base member 18 is mounted in recess 20 by securing it to a concrete portion of structural section 14 via bolt arrangement 62 and then filling recess 20 with grout and bonding sub-section 28 including side wall 39 with ribs 106 formed thereon to the grouted portion of section 14. Then, end section 102 of leaf-spring is fixedly interconnected with base member 22 via engagement of engagement arm 104 on leaf-spring cover 26 with flange 93 on base member 22. The leaf-spring cover member 26 is then extended across the joint 12 and the free end section 27 of leaf-spring cover member 26 with floor covering 97 positioned and affixed thereto. Thereafter, sub-section 30 of base member 18 is interconnected with the previously secured sub-section 28 by engaging the free end 57 of the diagonal side leg 52 of sub-section 30 within detent 56 in sub-section 28 and by engagement of screw 32 with sub-sections 28 and 30. In this manner, free end section 27 of leaf-spring 26 having floor covering 97 secured thereto is captured and secured within passageway 72 formed between diagonal side leg 52 of sub-section 28 and second section 68 of armature assembly 64 with top portion 70 of section 68 pressing against end section 27.

Turning now to FIG. 2, the improved expansion-joint cover assemblies of the instant invention can be understood and appreciated. Structural section 14 is fitted with a similar elongate rigid base member 18 positioned in a recessed area 20 as in FIG. 1. Base member 18 anchors and supports an elongate leaf-spring cover member 26 which extends over elongate expansion joint 12 between structural sections 14 and 16 as described above with respect to FIG. 1. An elongate rigid base member 118 is positioned in recessed area 20 formed in floor section 14 and secured to section 14 in a manner such that member 118 is held in a stationary of fixed position relative to section 14. Base member 118 may also be fabricated from any suitable metallic material including aluminum or brass or from a suitable plastic material.

As is true of base member 18 of FIG. 1, base member 118 of FIG. 2 is fabricated from a number of individual sub-sections, base 128, top 130, spring support portion 170 and trim strip portion 190. Sub-section or base 128 includes a horizontally extending bottom portion or member 134 which is positioned in abutting engagement with lower wall surface 36 of recess 20 of structural section 14. At a first end, adjacent side wall surface 39, a laterally-elongate vertical side portion or member 140 of sub-section 128 extends generally perpendicular to and upwardly from bottom portion 134 in abutting engagement with side wall surface 39 of recess 20. End 142 of member 140 lies in a plane substantially flush with the outer surface 38 of floor 14. Adjacent end 142, an elongate lateral flange 144 is formed on vertical member 140. This flange 144 contains threaded apertures or bores 146 to receive bolts 132 for joining together base 128 and top 130.

Top 130 comprises laterally elongate, rigid upper leg 154 and diagonal side leg 156. Outer surface 151 of leg 154 will accommodate a floor covering 53 as above described. Leg 156 extends diagonally downward from the nose portion 158 which joins legs 154 and 156 at an acute angle relative to leg 154 so that when base 128 and top 130 are joined, the legs 154, 156 and vertical portion 140 essentially define a cantilever bracket 160, with leg 156 defining the hypotenuse of a right triangle.

Top 130 and base 128 are fixedly attached to one another, as set out above, by means of the bolts 132 engaging the threaded bores 146 of flange 144. Top 130 and base 128 are further connected by the engagement of free end 157 of leg 156 with the detent 135 formed between vertical side member 140 of base 128 and an adjacent upwardly-projecting elongate rib 159 parallel with and spaced apart from side member 140.

Apertures or bores 161 are formed in bottom member 134 intermediate its length to accommodate a bolt arrangement 72 such as Hilti "Kwik" bolt for connecting the base 118 to floor section 14. An armature assembly 151 extends upwardly from the other or free end of bottom member 134 with a first section 146 extending generally normal to or perpendicular to base member 134, a second section 150 bent at an acute angle from the first section 146 extending upwardly in a plane essentially parallel to the plane of leg 156, and a third section 152 parallel with and spaced apart from base member 134. An aperture 162 in third section 152 permits the attachment of a spring support portion 170.

Spring support portion 170 has an upper body portion 172 and a lower body portion 174 coupled together by a web portion 176. An aperture 178 in upper body portion 172 and a threaded bore 180 in lower body portion 174 are aligned with aperture 162 in third section 152 to permit a bolt 182 to hold spring support portion 170 and third section 152 in assembly. A tip portion 184 projects upwardly from upper body portion 172 to engage the underside of leaf-spring cover member 26. By selecting the proper length of tip portion 184, cover member 26 and its covering 97 can be properly supported on the underside of trim strip portion 190. Spring support portion 170 can be readily replaced to provide a tip portion 184 of the proper length to aecommodate the combined thickness of the member 26 and covering 97.

Trim strip portion !90 includes a trim piece 192 adjacent a recessed portion 194 lying in the plane of and generally continuous with outer surface 38 of floor 14. Thus, covering 53 extends to trim piece 192 which acts as a border for such covering and may be provided in colors such as gold, silver, bronze, etc., to compliment the covering 53. The underside 196 of trim 192 acts as the support for covering 97 and cover member 26 in contact with tip portion 184.

The free end 198 of trim strip portion 190 is arranged to nest in recess 155 of nose portion 158. An aperture 200 in end 198 aligns with a threaded aperture 202 in nose portion 158 to receive a bolt 204 to hold strip portion 190 in assembly with nose portion 158. A slot 206 in nose portion 158 receives a further leg 208 of portion 190 to further support trim strip portion 190 on nose portion 158. To change the trim strip portion 190 in order to alter the color of trim piece 192, or its size, or to alter the height of recessed portion 194 to accommodate finish floor materials of different thicknesses, it is merely necessary to remove covering 53 from the trim strip portion 190, remove bolt 204 and slide the portion 190 free of nose portion 158. A trim strip portion 190 of the proper color and dimensions can now be slid into place, bolted to nose portion 158 by reinstalling bolts 204 and covered by the appropriate covering 53.

The installation of the expansion joint 10' illustrated in FIG. 2 is essentially the same as the installation of the expansion joint 10 in FIG. 1 as set forth above except as noted with respect to spring support 170 and trim strip portion 190.

Figure 3:
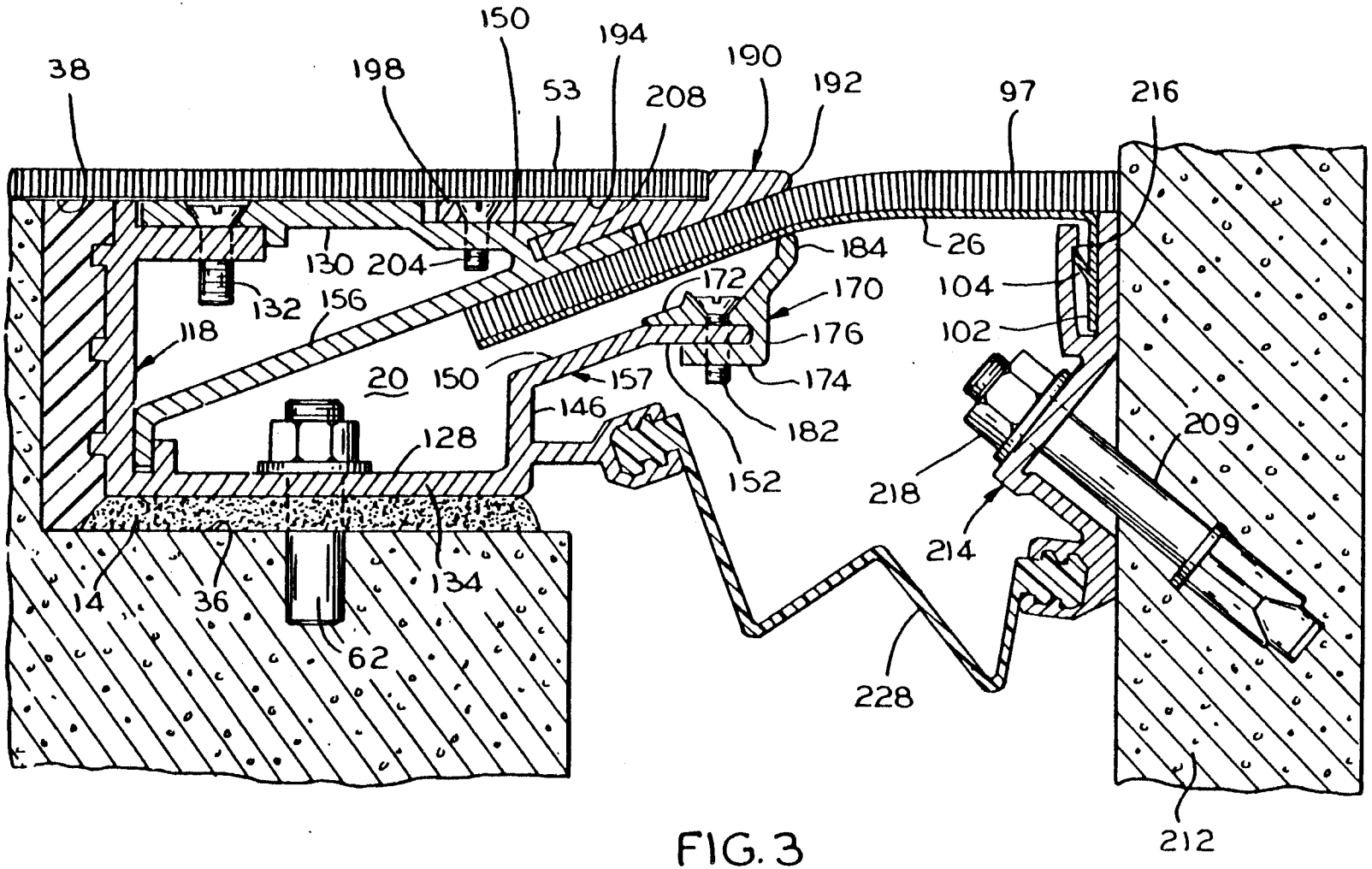
FIG. 3 is a transverse sectional view of another embodiment of the improved expansion-joint cover assemblies of the present invention installed to cover an expansion joint adjacent angularly disposed wall and carpeted floor sections.

FIG. 3 shows base member 118 attached to a floor section 14 in the manner of FIG. 2 and the spring cover member 26 attached by a base member 214 fastened to wall member 212. Barb 104 of free end 102 of member 26 engages detent 216 to hold member 26 to base member 214. The remainder of the installation and operation of this expansion-joint cover assembly is the same as detailed above with respect to FIG. 1.

A standard gutter member 228 of extruded elastomeric material is secured between the base members 18 and 22 as illustrated in FIG. 1, base members 118 and 22 as illustrated in FIG. 2 and base members 118 and 214 of FIG. 3, in order to collect and convey moisture passing between the adjacent, spaced structural sections.

While there have been described what are at present considered to be the preferred embodiments of the invention, it will be understood that various modifications may be made therein, and it is intended to cover in the appended claims all such modifications as fall within the true spirit and scope of the invention.

We claim:

1. In an improved expansion-joint cover assembly for a joint formed between first and second adjacent, spaced structural sections comprising:

a first base ember stationarily secured to said first structural section;

a second base member stationarily secured to said second structural section;

a cover member, having a first end secured to said first base member, extending across said joint in a cantilever manner overlying and covering said joint, said cover member having a second end for placement within a passageway formed in said second base member;

said second base member including first and second walls defining said passageway therein for receiving said second end of said cover member in supporting, sliding engagement, the improvement comprising:

an interchangeable trim strip portion removably secured at one end to the end of said first wall defining said passageway, said trim strip portion has a laterally-elongate body portion having an upper horizontal surface and an inclined lower surface, said trim strip portion terminating in a trim piece at a free end distal to the end of said trim strip portion which is removably secured to said first wall; and means to removably secure said trim strip portion to said first wall defining said passageway.

2. An improved expansion-joint cover assembly as defined in claim 1, wherein said means to removably secure said trim strip portion is a threaded fastener.

3. An improved expansion-joint cover assembly as defined in claim 1, wherein said trim strip portion further comprises an extending leg slidably positionable within a slot in said first wall to further join and support said trim strip portion upon said first wall.

4. In an improved expansion-joint cover assembly for a joint formed between first and second adjacent, spaced structural sections comprising:

a first base member stationarily secured to said first structural section;

a second base member stationarily secured to said second structural section;

a cover member, having a first end secured to said first base member, extending across said joint in a cantilever manner overlying and covering said joint, said cover member having a second end for placement within a passageway formed in said second base member;

said second base member including first and second walls defining said passageway therein for receiving said second end of said cover member in supporting, sliding engagement, the improvement comprising:

an interchangeable trim strip portion removably secured to the end of said first wall defining said passageway;

an interchangeable spring support means removably secured to the end of the second wall defining said passageway, said spring support means engaging said cover member and urging same into intimate contact with said trim strip portion.

5. An improved expansion-joint cover assembly as defined in claim 4, wherein said spring support means comprises:

a body portion removably securable to the free end of said second wall defining said passageway;

fastening means for securing said spring support body portion to said second wall; and tip means coupled to said body portion to contact said spring support means.

6. An improved expansion-joint cover assembly as defined in claim 5, wherein the length of said tip means above said spring support body portion is selected in accordance with the thickness of said cover member with which it is employed.

7. An improved expansion-joint cover assembly as defined in claim 5, wherein said means to removably secure said spring support means to said second wall is a threaded fastener.

8. In an expansion-joint cover assembly for a joint formed between first and second adjacent, spaced structural sections comprising:

a first base member stationarily secured to said first structural section;

a second base member stationarily secured to said second structural section;

a cover member, having a first end secured to said first base member, extending across said joint in a cantilever manner overlying and covering said joint, said cover member having a second end for placement within a passageway formed in said second base member; said second base member including a passageway therein defined by a first wall and a second wall, said first wall being aligned generally parallel to and spaced-apart from said second wall for receiving therebetween said second end of said cover member in supporting, sliding engagement, the improvement comprising:

an interchangeable trim strip portion removably secured at one end to the end of said first wall of said passageway, and an interchangeable spring support means removably secured to the end of said second wall of said passageway whereby said cover member is contained and supported between said trim strip portion and said spring support means.

9. An improved expansion-joint cover assembly as defined in claim 8, wherein said trim strip portion has a laterally elongate body portion having an upper horizontal surface and an inclined lower surface terminating in a trim piece at a free end distal to the end of said trim strip portion which is removably secured to said first wall, and means to removably secure said trim strip portion to said first wall.

10. An improved expansion-joint cover assembly as defined in claim 9, wherein said means to removably secure said trim strip portion is a threaded fastener.

11. An improved expansion-joint cover assembly as defined in claim 9, wherein said trim strip portion further comprises an extending leg slidably positionable within a slot in said first wall to further join and support said trim strip portion upon said first wall.

12. An improved expansion-joint cover assembly as defined in claim 9, wherein said spring support means comprises:

a body portion removably securable to the end of said second wall;

fastening means for securing said spring support body portion to said second wall; and tip means coupled to said body portion to contact said spring support means.

13. An improved expansion-joint cover assembly as defined in claim 12, wherein the length of said tip means above said spring support body portion is selected in accordance with the thickness of said cover member whereby the cover member is urged into intimate contact with the inclined surface of said trim strip portion when the second end of said cover member is inserted in said passageway.

14. An improved expansion-joint cover assembly as defined in claim 9, wherein said fastening means is a threaded fastener.

* * * * *